US009696124B2

(12) United States Patent
Keska

(10) Patent No.: US 9,696,124 B2
(45) Date of Patent: Jul. 4, 2017

(54) CARTRIDGE CASE PROCESSING DEVICE

(71) Applicant: Wojciech Keska, Wallenhorst (DE)

(72) Inventor: Wojciech Keska, Wallenhorst (DE)

( * ) Notice: Subject to any disclaimer, the term of this patent is extended or adjusted under 35 U.S.C. 154(b) by 0 days.

(21) Appl. No.: 14/848,692

(22) Filed: Sep. 9, 2015

(65) Prior Publication Data

US 2017/0067726 A1 Mar. 9, 2017

(51) Int. Cl.
*F42B 33/10* (2006.01)
*F42B 33/14* (2006.01)

(52) U.S. Cl.
CPC ..... *F42B 33/10* (2013.01); *F42B 33/14* (2013.01)

(58) Field of Classification Search
CPC ..... F42B 33/10; F42B 33/14
USPC ..... 86/19.5, 19.7, 44
See application file for complete search history.

(56) References Cited

U.S. PATENT DOCUMENTS 3,174,390 A * 3/1965 Jacobsen ..... F42B 35/02 86/19.7
3,440,923 A * 4/1969 Purdie ..... F42B 33/005 86/43
3,555,641 A 1/1971 Lee
3,580,127 A * 5/1971 Lee ..... F42B 33/10 86/24
4,325,282 A 4/1982 Schaenzer
4,653,157 A 3/1987 Alexander
5,125,316 A 6/1992 Markle
5,180,260 A 1/1993 Phillips, Sr.
5,309,813 A 5/1994 Henley
5,635,661 A 6/1997 Tuftee
5,649,465 A 7/1997 Beebe
6,101,915 A 8/2000 Sinclair
7,650,825 B1 1/2010 Lee et al.
7,681,481 B1 * 3/2010 Buckley ..... F42B 33/005 86/26
8,827,607 B1 9/2014 Goodman
2011/0232467 A1 9/2011 Keska
2015/0159985 A1 6/2015 Keska

FOREIGN PATENT DOCUMENTS

DE 102013020748 * 8/2014

* cited by examiner

*Primary Examiner* — Stephen M Johnson
(74) *Attorney, Agent, or Firm* — David P. Dickerson

(57) ABSTRACT

The present disclosure relates to a cartridge case processing device, comprising: a trimmer holder comprising a first section that receives a die body and a second section provided with a through hole that receives a rotatably mounted rod upon which a cutter is arranged; and an adjusting device positioned coaxial to the rod and comprising a hollow cylindrical component provided with a threaded section that extends at least partially into the second section and engages with an internal threaded section of the second section, the hollow cylindrical component being rotatable relative to the trimmer holder, the adjusting device comprising an operating section for manual rotation of the hollow cylindrical component in relation to the trimmer holder.

18 Claims, 4 Drawing Sheets

CARTRIDGE CASE PROCESSING DEVICE

BACKGROUND OF THE DISCLOSURE

Field of the Disclosure

This invention relates to a cartridge case processing device for producing, preparing or refurbishing empty cartridge cases.

Description of the Related Art

High levels of dimensional accuracy are demanded when preparing cartridge cases, in particular for precision ammunition. Firing a cartridge case leads to an increase in its diameter along its entire length as well as to a linear expansion of the cartridge case. A cartridge case deformed by firing the cartridge must be refurbished to a suitable shape to be reused.

In view of the aforementioned prior art, it is the object of the present disclosure to provide a cartridge case processing device for producing, preparing and/or refurbishing empty cartridge cases that allows simple tool-free handling, while simultaneously facilitating precise tooling of the cartridge case.

SUMMARY OF THE PRESENT DISCLOSURE

The present disclosure teaches a trimmer holder for a trimming and sizing device designed to prepare empty cartridge cases, comprising a lower section, which receives a die body, as well as an upper section provided with a through hole that receives a rotatably mounted rod upon which a cutter is arranged and an externally accessible adjusting device positioned coaxial to the rod is proposed, which is characterized in that the adjusting device embodies a hollow cylindrical component provided with a threaded section that partially extends into the upper section, which can be brought into engagement with an internal threaded section on the inside of the upper section and that the adjusting device comprises an operating section that is arranged on the end of the component located outside the upper section, by which means the component can be rotated in relation to the trimmer holder. According to the invention the embodiment of the adjusting device has the advantage that for its assembly it is possible to insert the adjusting device as a whole into the through hole of the upper section of the trimmer holder. For this purpose the adjusting device can be formed in one piece. That additionally simplifies assembly. In comparison with the prior art fabricating the trimmer holder is simplified, because it dispenses with receiving an adjusting nut on a recess coaxial to the through hole in the upper section. The threaded section of the adjusting device may be implemented as a fine-pitch thread.

To simplify handling when making settings the operating section can embody the form of a flange. At the same time the operating section can partially extend past the upper section of the trimmer holder; this provides a good level of accessibility to operate the operating section to precisely adjust [the position of] the cutter. In particular, the operating section may be provided with a serrated surface around its circumference. The non-slip effect provided by the serrated surface of the radially expanding end of the operating section ensures reliable handling when turning the adjusting device to set the position of the cutter when trimming.

The hollow cylindrical component may comprise a setting section between the threaded section and the operating section. The function of this setting section is to adjust the axial position of the cutter incrementally. Incremental adjustment to finely adjust the axial position of the cutter instead of infinitely variable adjustment simplifies the trimming process with reproducible settings, and prevents unintentional maladjustment of the position of the cutter that does not correspond precisely to the length to which the cartridge case is to be shortened according to the caliber.

For this purpose the setting section may be provided with flutes arranged in an evenly distributed manner around its circumference, which can be brought into form-locked engagement with a locking element arranged in the upper section of a trimmer holder. The distance between the flutes in relation to one another may be chosen so that due to the low pitch of the threaded section implemented as a fine-pitch thread the individual [setting] increments from one flute to the next flute are made in increments as fine as in the hundredths of a millimeter (or in thousandths of an inch) range.

Furthermore, the wall of the through hole can provide the circumferential surface of the setting section enclosing the flutes with support so that this has a stabilizing effect on the hollow cylindrical component in a radial direction. The setting section has a dual function. On the one hand, the setting section makes it possible to precisely adjust the cutter, and on the other hand the setting section helps to stabilize the trimming and sizing device by absorbing the force components acting in a radial direction that result when operating the trimming and sizing device by turning the rod by means of a crank and handle so that the load forces acting on the threaded section of the hollow cylindrical component are reduced.

In particular, it is possible to adjust the spring force applied to the locking element. In that manner it is possible to individually adjust the perceived resistance when the locking implement makes the transition between two flutes while finely adjusting the axial position of the cutter. For this purpose it is possible to arrange a spring, preferably a coiled spring, in a through bore on a side of the trimmer holder that it is possible to access with a tool. To facilitate adjusting the spring, it is possible to engage a fastening element, preferably a setscrew, in the through bore in the upper section of the trimmer holder. By adjusting this fastening element it is possible to set the spring force applied to the locking element by the spring.

The flutes can partially extend in a lengthwise direction along the component. At the same time their extension should be chosen to be greater than the adjustment distance the component can travel when operating the operating section resulting from the axial extension of the threaded section of the component and the internal threaded section in the upper section. Thus, in this way it is possible to ensure that the locking element can be engaged in one of the flutes along the entire adjustment distance when altering the axial position of the cutter.

In this way it is possible to arrange a stop nut on the end of the upper section that faces the lower section and which partially extends coaxially to the rod into the through hole in the upper section. The stop nut can be provided with a flange-shaped base with which the stop nut can be supported by the underside of the upper section of the trimmer holder.

A further embodiment of the invention envisages that at least one fixing device is arranged in the upper section of the trimmer holder, which bears with its contact surface friction-locked against the circumferential surface of the setting section. The advantage of this is that it is possible to dispense with recesses in the setting section, so that from a production point of view it is easier to fabricate. The setting section can have a smooth circumferential surface upon which the at least one fixing device rests with its contact surface that corresponds to the circumferential surface. In this way it possible to make infinitely variable adjustments to the position of the cutter.

At the same time it is possible for the at least one fixing device to be subjected to an adjustable spring force. To achieve this objective it is possible to arrange a compression spring in the upper section of the trimmer holder, which can apply a spring force to the fixing device in the direction of the circumferential surface of the setting section. The static friction force between the at least one fixing device and the circumferential surface secures the cutter in position following its fine adjustment. It is possible to set the spring force of the compression spring by means of a setscrew or similarly designed fastening element.

Alternatively, the at least one fixing device can be tensioned in relation to the circumferential surface of the setting section by means of a fastening element that acts directly on the respective fixing device. The fastening element can be implemented as a setscrew or similar, which presses the at least one fixing device directly against the circumferential surface of the setting section.

The resulting friction force that occurs between the at least one fixing device and the circumferential surface ensures the position of the cutter set by means of the operating section of the trimmer holder is maintained, and can easily be set by a person operating the trimmer holder by means of the fastening element implemented as a setscrew or similar.

To achieve this objective the fixing device should be made from a resilient material.

The present disclosure teaches an embodiment of a cartridge case processing device, comprising: a cartridge holding portion comprising a hollow that receives a cartridge case; a rotary bearing; a supporting portion that supports the rotary bearing relative to the cartridge holding portion; and a cutter mounted on a shaft rotatably mounted, via the rotary bearing, in the supporting portion, an outer circumference of the rotary bearing comprising a threaded portion that engages a threaded portion of the supporting portion. The rotary bearing may comprise a dial portion external to the supporting portion, the dial portion allowing manual rotation of the thread portion of the rotary bearing relative to the thread portion of the supporting portion. Furthermore, the dial portion may comprise scale marks.

The invention is not limited to the specified combination of characteristics of the independent patent claims and those of their dependent patent claims. Furthermore, other options to combine individual characteristics with one another arise, in particular then when they result from the patent claims, from the following description of the exemplary embodiments or directly from the drawing. In addition, reference of patent claims to the drawings through the use of reference characters shall not under any circumstances limit the scope of protection of the patent claims to the exemplary embodiments depicted.

The present invention is explained in more detail below using an exemplary embodiment depicted in the drawings.

DETAILED DESCRIPTION

Figure 1:
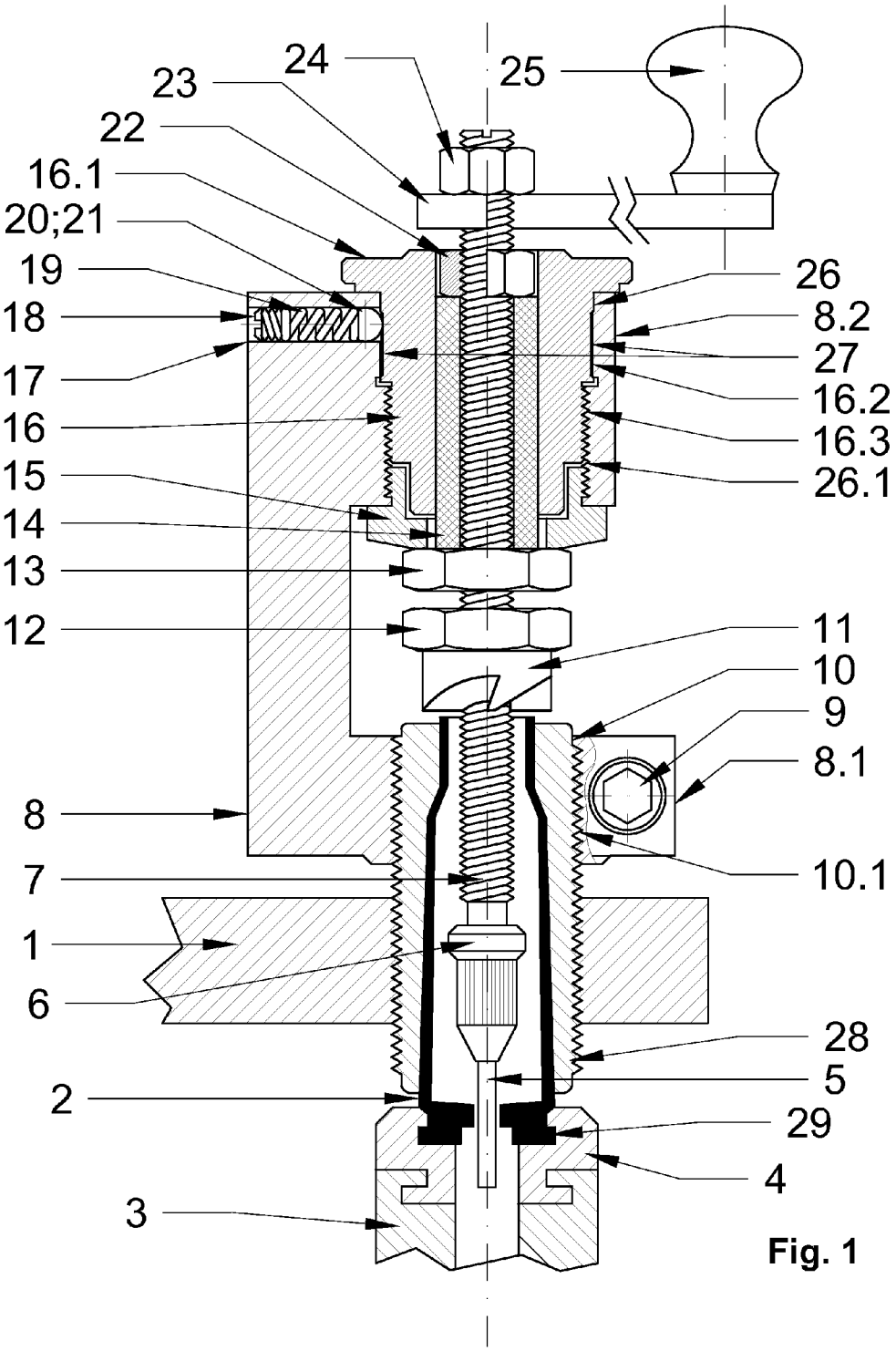
FIG. 1 A sectional side view of a trimmer holder with an adjusting device

In FIG. 1 a sectional side view is depicted of a trimmer holder 8 with an adjusting device of a trimming and sizing device. A loading press, of which just a holder arm section is partially depicted, is provided with the reference number 1. The loading press 1 serves to receive the trimmer holder 8 of the trimming and sizing device, which includes a die body 28 and other components. The die body 28 has a hollow interior into which a cartridge case 2 can be precisely inserted to be trimmed and sized. The die body 28 is provided with an external thread with which it is possible to screw the die body 28 into a corresponding internal threaded section of the holder arm section of the loading press 1. The base 29 of the cartridge case 2 is fixed in position by a case holder 4 into which it is possible to detachably place the cartridge case 2. The case holder 4 can be moved in a vertical direction by means of a pressing ram 3, which is part of the loading press 1.

The die body 28 is partially screwed into a lower section 8.1 that extends parallel to the holder arm section of the loading press 1 of the essentially C-shaped trimmer holder 8 of the trimming and sizing device. The trimmer holder 8 can also be of a shape that essentially corresponds to a horizontal U form. For this purpose the lower section 8.1 of the trimmer holder 8 is provided with a through hole 10 with an internal threaded section 10.1. A clamping screw 9 serves to press together or loosen the slotted section 8.1 of the trimmer holder 8 so that it is possible to fix or adjust the position of the die body 28 in relation to the trim holder 8 by means of its external thread. The die body 28 joins the trimmer holder 8 to the loading press 1.

An upper section 8.2 of the trimmer holder 8 extends parallel to the lower section 8.1, which is also provided with a through hole 26. The through hole 26 is arranged coaxially to the through hole 10 in the lower section 8.1. The through hole 26 is provided with an internal threaded section 26.1 that beginning at the underside of the upper section 8.2 extends partially in the direction towards the top of the upper section 8.2. The upper section 8.2 of the trimmer holder 8 serves to receive a rod 7 that is at least in part provided with a thread, which in turn can be operated manually by means of a crank 23, which is provided with a handle 25 fastened at one end [for that purpose], arranged on one end of the rod 7. The crank 23 is secured on the rod 7 by means of lock nut 24. Viewed in the direction of the die body 28 a cutter 11 is arranged on the rod 7 between the upper section 8.2 and the lower section 8.1; the position of the cutter 11 can be set in an axial direction on the threaded section of the rod 7. The cutter 11 is secured in position by a locknut 12 to prevent unintentional axial adjustments along the rod 7. The cutter 11 serves to shorten the elongated cartridge neck of a used cartridge case 2 to the measurement required according to the caliber of the cartridge. To achieve this objective the cutter 11 is positioned on the rod 7 at a distance to the cartridge neck according to the caliber of the cartridge case 2 to be shortened and secured in position by a locknut 12. A further setting option is given by positioning the die body 28 in relation to the trimmer holder 8. It is possible to set the position of the die body 28 by means of its external thread in such a manner that it projects past the lower section 8.1 of the trimmer holder 8 by varying amounts in an axial direction, by which means it is also possible to set the clearance to the cutter 11. To facilitate the subsequent fine adjustment of the axial position of the cutter 11 in relation to the die body 28 an adjusting device is provided on the trimmer holder 8, which will be described in more detail further below.

Below the cutter 11 an expander die 6 is provided to which a decapping pin 5 is attached. For a coaxial arrangement on the rod 7 the cutter 11, the expander die 6 as well as the decapping pin 5 are screwed onto a section, not shown, of the rod 7.

To support the rotatable rod 7 it is partially enclosed by a plain bushing 14, which is arranged in the through hole 26 in the upper section 8.2 of the trimmer holder 8. A lower part of the plain bushing 14 that extends towards the lower section 8.1 of the trimmer holder 8 is received by a stop nut 15 that is provided with a flange-shaped base. The flange-shaped base of the stop bushing 15 is supported by the underside of the upper section 8.2 of the trimmer holder 8. The remaining part of the plain bushing 14 is received by a component implemented as a bushing 16, which serves as an adjusting device of the trimmer holder 8 to finely adjust the axial position of the cutter 11. To secure the set axial position of the plain bushing 14 two locknuts 13 and 22 are provided, one of each at each respective end of the plain bushing 14.

The bushing 16 acting as an adjusting device of the trimmer holder 8 is provided with an operating section 16.1, a setting section 16.2 as well as a threaded section 16.3. It is possible to fit bushing 16 into the through hole 26 from the top of the upper section 8.2. The operating section 16.1 embodies the shape of a flange so that this partially projects above the upper section 8.2 in a radial direction. This design embodiment provides good accessibility to the operating section 16.1 so as to allow it to be turned to make fine adjustments to [the position of] the cutter 11. The axial position of the bushing 16 depicted in FIG. 1 is the end position in which the operating section 16.1 bears against the top of the upper section 8.2. In this way the top of the upper section 8.2 serves as a limit stop for the adjusting device designed in the form of a bushing 16.

The setting section 16.2 of the bushing 16 is located below the operating section 16.1. A number of flutes 27 are distributed evenly around the circumference of the setting section 16.2. The flutes 27 extend paraxial to the longitudinal axis of the rod 7. The flutes 27 extend in an axial direction, extending almost along the entire axial length of the setting section 16.2 between the operating section 16.1 and the threaded section 16.3. In addition, the setting section 16.2 has the added function of providing the bushing 16 with radial stability. Consequently, the forces acting in a radial direction when the crank 23 is operated by means of the handle 25 are not only absorbed by the threaded section 16.3 but in particular by the setting section 16.2.

It is possible to engage the bushing 16 with the internal thread 26.1 of the through hole 26 by means of the threaded section 16.3. The threaded section 16.3 and the corresponding internal threaded section 26.1 in the through hole 26 are implemented as fine-pitch threads. The fine-pitch thread makes it possible to vary the preset axial position of the cutter 11 in relation to the die body 28 in increments in a range as fine as hundredths of a millimeter (in thousandths of an inch).

A through bore 17 is provided in the upper section 8.2, which runs vertically in relation to the rod 7. A locking element 20 is arranged inside this through bore 17, which it is possible to engage in one of the flutes 27 on the circumference of the setting section 16.2. A spring 19, preferably a coiled spring, is arranged in the through bore 17, which applies compressive force to the locking element 20. The spring 19 is simultaneously supported by a fastening element 18 inserted in the through bore 17. The fastening element 18 implemented as a setscrew or similar is arranged in the through bore 17 in the upper section 8.2 of the trimmer holder 8 in a manner that ensures it can be accessed from the outside using a tool, so that it is possible to vary the spring force exerted by the spring 19 on the locking element 20. For this purpose, the through bore 17 is provided with an internal threaded section with which the fastening element 18 implemented as a setscrew engages. Varying the spring force applied to the locking element 20 allows the person operating the trimmer holder 8 to alter the setting behavior when turning the operating section 16.1. The locking element 20 can be implemented as a ball 21, for example. Other geometric design forms of the locking element 20 are conceivable, for example a regular cylinder shape.

Figure 2:
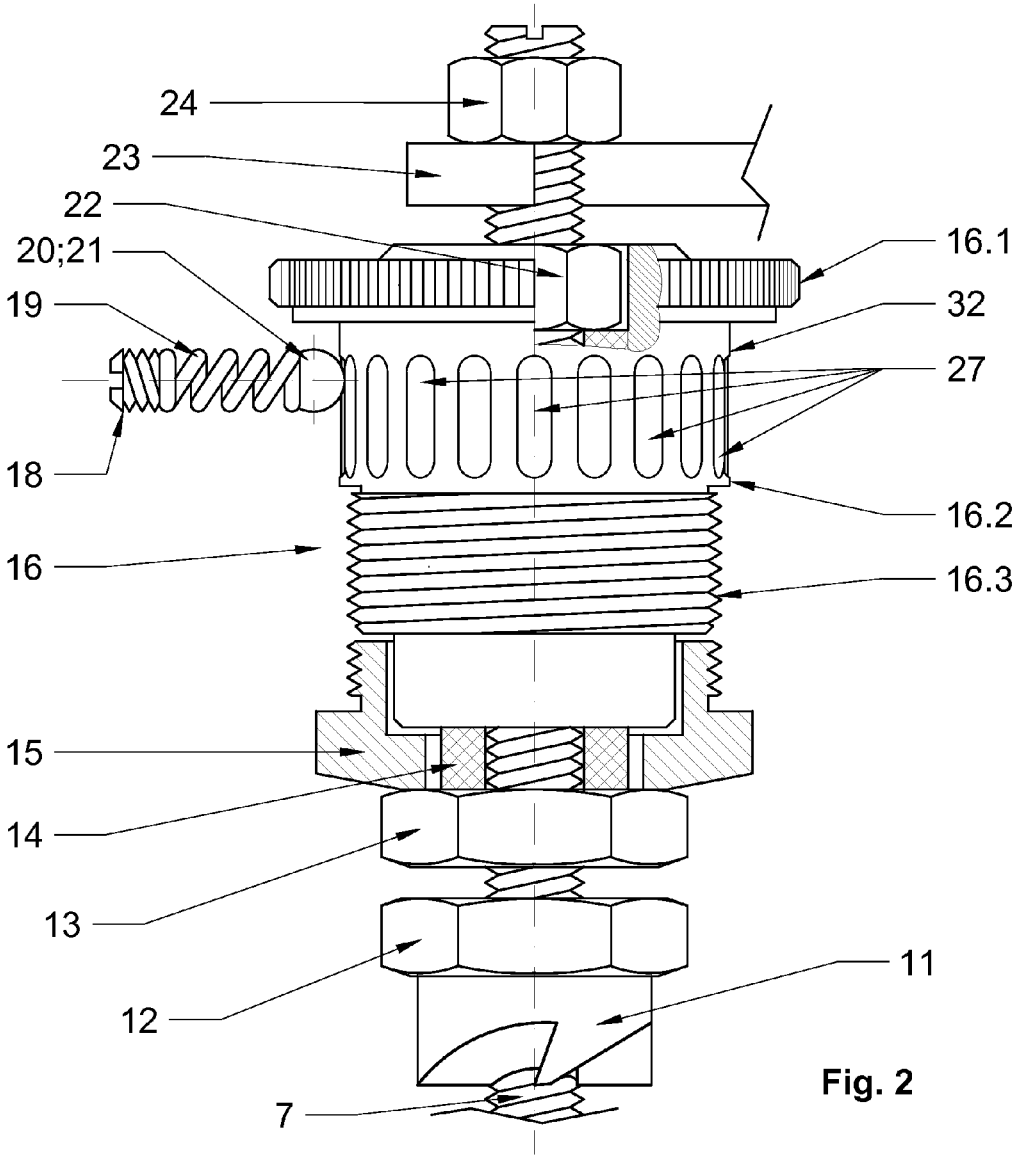
FIG. 2 A detailed view in part section of the adjusting device according to FIG. 1

The drawing in FIG. 2 depicts a detailed view in part section of the adjusting device according to FIG. 1, whereby, a depiction of the trimmer holder 8 that receives the adjusting device has been omitted for the purpose of improved clarity of detail. The drawing clearly illustrates the construction of the adjusting device implemented as bushing 16. To finely adjust the preset axial position of the cutter 11 in relation to the die body 28 the bushing 16 is operated by turning the operating section 16.1 provided with a serrated surface around its outer circumference. As previously indicated above the drawings in FIGS. 1 and 2 show the bushing 16 in an end position, which is reached by making full use of the adjusting distance provided by the threaded section 16.3. That means that the operating section 16.1 bears against the top of the upper section 8.2 of the trimmer holder 8.

The locking element 20 is located in the depicted position of the adjusting device that is implemented as a bushing 16 at the top of one of the flutes 27 of the setting section 16.2 facing towards the end with the operating section 16.1. The axial extension of the flutes 27 has been selected in such a manner that the locking element 20 can engage at all times in one of the flutes 27 when adjustments are made. Turning the bushing 16 effects an axial displacement of the plain bushing 14 therein and the rod 7 guided therein relative to the upper section 8.2 of the trimmer holder 8 and, as a consequence, a change in the position of the cutter 11 towards the neck of the cartridge case 2.

Figure 3:
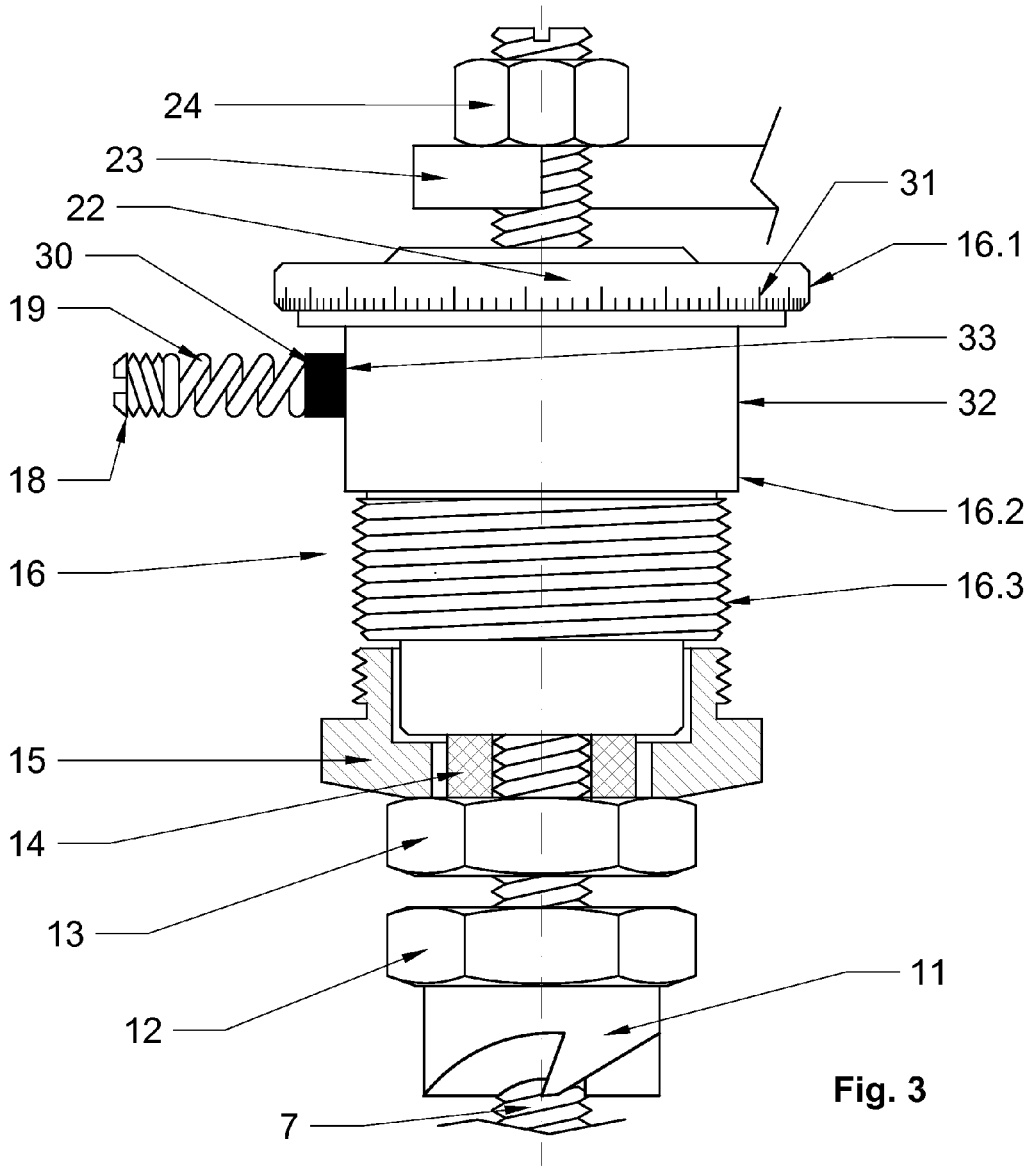
FIG. 3 A detailed view in part section of an adjusting device according to a second embodiment FIG. 4 A detailed view in part section of the adjusting device according to FIG. 3 with a fixing device to fix the axial position of the adjusting device in the trimmer holder.

FIG. 3 depicts a detailed view in part section of an adjusting device according to a second embodiment. Implemented as a hollow cylindrical bushing 16 the adjusting device is provided with a scale 31 instead of a serrated surface around the circumference of its flange-shaped operating section 16.1, for example in the form of knurling; the graduation of the scale corresponds to incremental settings in increments of hundredths of a millimeter (in increments of thousandths of an inch). Making the increments visible by means of the scaling 31 makes it easy for the user to set the position of the cutter. The setting section 16.2 differs from the embodiment depicted in FIGS. 1 and 2 in as much as that it has been implemented with a smooth circumferential surface 32. There are no flutes distributed and arranged around its circumference. To fix the cutter 11 in position once it has been finely adjusted by operating the operating section 16.1 there is at least one fixing device 30 provided, the contact surface 33 of which bears against the circumferential surface 32 of the setting section 16.2. The form of the contact surface 33 of the at least one fixing device 30 corresponds to the form of the circumferential surface 32 of the setting section 16.2. As previously described in conjunction with FIG. 1 at least one through bore 17 is arranged in the upper section 8.2 of the trimmer holder 8, which receives the fixing device 30. The spring 19, which is supported by the fastening element 18, applies a load force against the fixing device 30 is such a manner that this is in turn pressed against the circumferential surface 32. The static friction between the fixing device 30 and the circumferential surface 32 ensures that the cutter 11 is restrained in the position set after it is finely adjusted by operating the trimming and sizing device.

Figure 4:
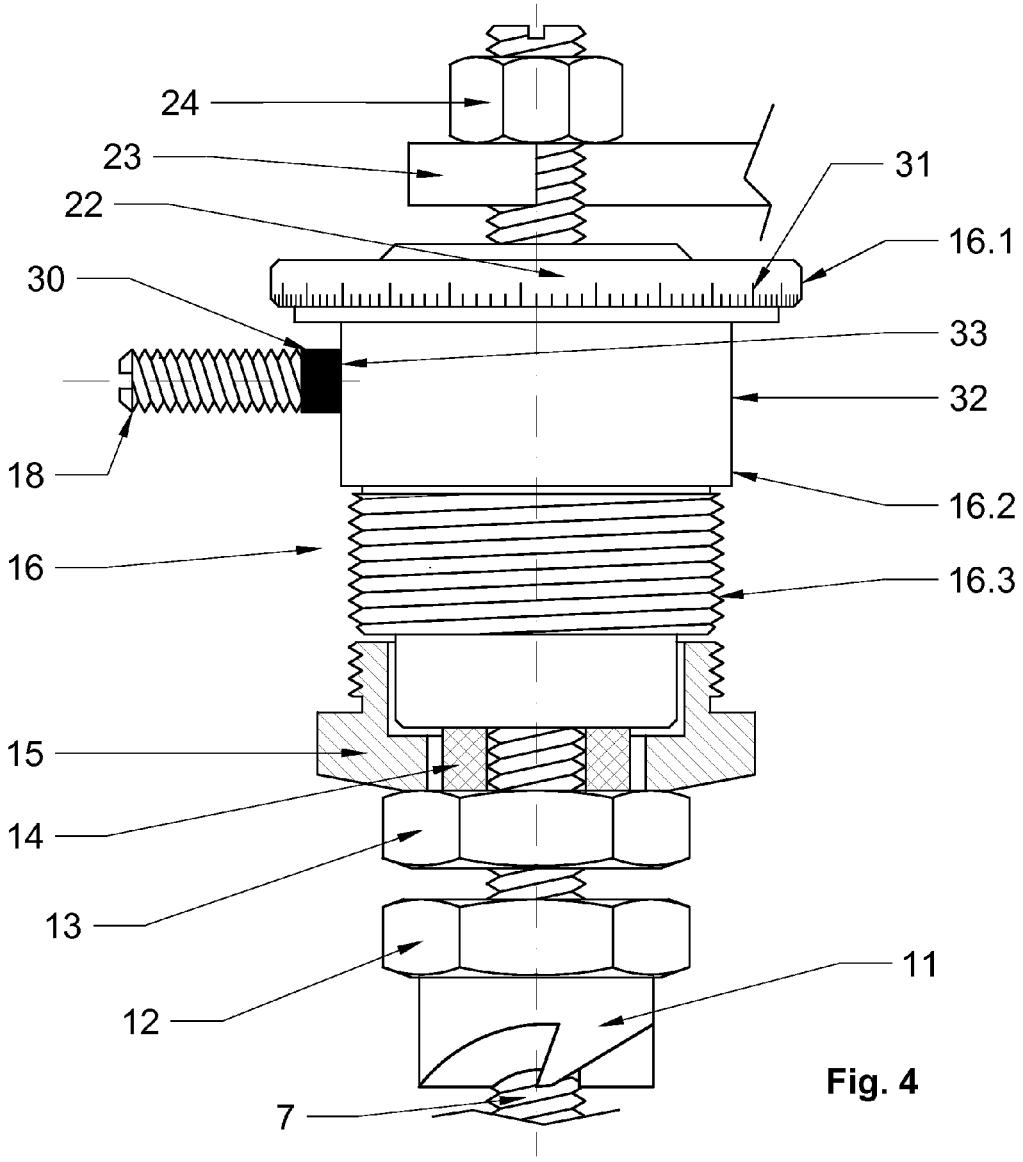

The drawing in FIG. 4 depicts a detailed view in part section of the adjusting device according to FIG. 3 with at least one fixing device 30 to fix the axial position of the adjusting device 16 in the trimmer holder 8. In contrast to the version depicted in FIG. 3 and according to this described embodiment the spring 19 in the through bore 17 is dispensed with. The at least one fixing device 30 is pressed directly against the circumferential surface 32 of the setting section 16.2 by the fastening element 18. To adjust the force applied to the at least one fixing device 30 the through bore 17 is as previously described above provided with an internal thread so that the force applied by the fastening element 18 to the fixing device 30 is adjustable.

LIST OF REFERENCE SIGNS

1 Loading press
2 Cartridge case
3 Pressing ram
4 Case holder
5 Decapping pin
6 Expander die
7 Rod
8 Trimmer holder
8.1 Lower section of trimmer holder 8
8.2 Upper section of trimmer holder 8
9 Clamping screw
10 Through hole
10.1 Internal threaded section of through hole 10
11 Cutter
12 Locknut
13 Locknut
14 Bushing
15 Stop nut
16 Bushing
16.1 Operating section
16.2 Setting section
16.3 Threaded section
17 Through bore
18 Fastening element
19 Spring
20 Locking element
21 Ball
22 Locknut
23 Crank
24 Locknut
25 Handle
26 Through hole
26.1 Internal threaded section of through hole 26
27 Flute
28 Die body
29 Bottom of cartridge case 2
30 Fixing device
31 Scaling
32 Circumferential surface
33 Contact surface

The invention claimed is:

1. A cartridge case processing device, comprising:

a trimmer holder comprising a first section that receives a die body and a second section provided with a through hole that receives a rotatably mounted rod upon which a cutter is arranged; and an adjusting device positioned coaxial to said rod and comprising a hollow cylindrical component provided with a threaded section that extends at least partially into said second section and engages with an internal threaded section of said second section, said hollow cylindrical component being rotatable relative to said trimmer holder, said adjusting device comprising an operating section for manual rotation of said hollow cylindrical component relative to said trimmer holder, said hollow cylindrical component comprising a plurality of flutes arranged in an evenly distributed manner around a circumference of said hollow cylindrical component, a locking element being arranged in said second section, said locking element being form-lock engageable with any one of said plurality of flutes.

2. The device of claim 1, wherein said operating section is arranged proximate to an end of said hollow cylindrical component located outside said second section.

3. The device of claim 1, wherein said operating section is flange-shaped.

4. The device of claim 1, wherein said plurality of flutes is arranged between said threaded section and said operating section.

5. The device of claim 1, comprising a resilient element that applies a force to said locking element.

6. The device of claim 1, wherein a longitudinal dimension of each of said flutes is substantially parallel to an axis of rotation of said hollow cylindrical component.

7. The device of claim 1, comprising a stop nut arranged at an end of said second section that faces said first section, said stop nut extending, coaxially to said rod, at least partially into said through hole.

8. The device of claim 1, comprising a bushing, said hollow cylindrical component receiving said bushing, said rod being rotatably mounted in said bushing.

9. The device of claim 1, comprising a scale on a circumference of said adjusting device.

10. A cartridge case processing device, comprising:

a trimmer holder comprising a first section that receives a die body and a second section provided with a through hole that receives a rotatably mounted rod upon which a cutter is arranged;

an adjusting device positioned coaxial to said rod and comprising a hollow cylindrical component provided with a threaded section that extends at least partially into said second section and engages with an internal threaded section of said second section, said hollow cylindrical component being rotatable relative to said trimmer holder; and at least one fixing device arranged in said second section, said adjusting device comprising an operating section for manual rotation of said hollow cylindrical component relative to said trimmer holder, and said fixing device having a contact surface that frictionally engages an unthreaded circumferential surface of said hollow cylindrical component between said threaded section and said operating section to inhibit rotation of said hollow cylindrical component.

11. The device of claim 10, wherein said at least one fixing device comprises at least one of a spring and a force adjusting mechanism.

12. A cartridge case processing device, comprising:

a cartridge holding portion comprising a hollow that receives a cartridge case;

a rotary bearing;

a supporting portion that supports said rotary bearing relative to said cartridge holding portion; and a cutter mounted on a shaft rotatably mounted, via said rotary bearing, in said supporting portion, an outer circumference of said rotary bearing comprising a threaded portion that engages a threaded portion of said supporting portion, said rotary bearing comprising a plurality of grooves arranged in an evenly distributed manner around an outer circumference of said rotary bearing, a longitudinal dimension of each of said grooves being substantially parallel to an axis of rotation of said rotary bearing.

13. The device of claim 12, wherein a rotation of said threaded portion of said rotary bearing relative to said threaded portion of said supporting portion adjusts a position of said rotary bearing relative to said supporting portion and defines a maximum distance of said cutter from said supporting portion in a longitudinal direction of said shaft.

14. The device of claim 12, wherein said threaded portion of said supporting portion is integrally, fixedly formed in said supporting portion.

15. The device of claim 12, wherein said supporting portion is a unitary structure that interconnects said rotary bearing and said cartridge holding portion.

16. The device of claim 12, wherein said rotary bearing comprises a dial portion external to said supporting portion, said dial portion allowing manual rotation of said threaded portion of said rotary bearing relative to said threaded portion of said supporting portion.

17. The device of claim 16, wherein said dial portion comprises scale marks.

18. A cartridge case processing device, comprising:

a cartridge holding portion comprising a hollow that receives a cartridge case;

a rotary bearing;

a supporting portion that supports said rotary bearing relative to said cartridge holding portion; and a cutter mounted on a shaft rotatably mounted, via said rotary bearing, in said supporting portion, a rotation inhibiting mechanism that exerts a force on an outer circumference of said rotary bearing to inhibit rotation of said thread portion of said rotary bearing relative to said thread portion of said supporting portion, said rotation inhibiting mechanism comprising at least one of a spring and a force adjusting mechanism, an outer circumference of said rotary bearing comprising a threaded portion that engages a threaded portion of said supporting portion.

* * * * *